US011646477B2

(12) United States Patent
Tabatabai et al.

(10) Patent No.: US 11,646,477 B2
(45) Date of Patent: May 9, 2023

(54) WAVEGUIDE CROSS-COUPLING FILTER WITH MULTIPLE PARALLEL CAVITIES

(71) Applicant: Meta Platforms, Inc., Menlo Park, CA (US)

(72) Inventors: Farbod Tabatabai, San Francisco, CA (US); Haris Alijagic, Livermore, CA (US)

(73) Assignee: Meta Platforms, Inc., Menlo Park, CA (US)

( * ) Notice: Subject to any disclaimer, the term of this patent is extended or adjusted under 35 U.S.C. 154(b) by 77 days.

(21) Appl. No.: 17/190,450

(22) Filed: Mar. 3, 2021

(65) Prior Publication Data

US 2022/0285814 A1 Sep. 8, 2022

(51) Int. Cl.
*H01P 1/213* (2006.01)
*H01P 11/00* (2006.01)

(52) U.S. Cl.
CPC ..... *H01P 1/2138* (2013.01); *H01P 11/007* (2013.01)

(58) Field of Classification Search
CPC ..... H01P 11/007
See application file for complete search history.

(56) References Cited

U.S. PATENT DOCUMENTS 4,607,242 A * 8/1986 Cozzie ..... H01P 1/207 333/248
9,130,256 B2 9/2015 Rogozine et al.
2005/0128031 A1* 6/2005 Wilber ..... H01P 1/2082 333/202
2009/0231064 A1 9/2009 Bates et al.
2020/0373644 A1* 11/2020 Goulouev ..... H01P 1/208

FOREIGN PATENT DOCUMENTS

CN 107611541 A 1/2018
JP 2002100904 A * 4/2002

OTHER PUBLICATIONS

Sandhu et al., "Miniaturized Dielectric Waveguide Filters", Int'l Journal of Electronics, vol. 103, No. 10, Feb. 2, 2016, 19 pages.

(Continued)

*Primary Examiner* — Hafizur Rahman
*Assistant Examiner* — Kimberly E Glenn
(74) *Attorney, Agent, or Firm* — Greenberg Traurig, LLP

(57) ABSTRACT

The disclosed radio frequency (RF) bandpass filter may include an RF transmission medium that defines (1) a plurality of cavities aligned parallel to each other along a major axis, where (a) each cavity includes planar surfaces that define (i) a first dimension aligned with the major axis and (ii) second and third dimensions aligned perpendicular to the major axis and each other, where the first dimension is shorter than the second and third dimensions and (b) each adjacent pair of cavities is coupled by an inter-cavity slot, (2) an RF inlet that couples a received RF signal to a first cavity at a first end of the plurality of cavities, and (3) an RF outlet that couples a filtered RF signal from a second cavity at a second end of the plurality of cavities externally to the filter. Various other filters and manufacturing methods thereof are also disclosed.

20 Claims, 12 Drawing Sheets

(56) References Cited

OTHER PUBLICATIONS

Zhu, Li, "High-Q Multi-Band Filters", URL: https://uwspace.uwaterloo.ca/bitstream/handle/10012/15023/ZHU_LI.pdf?sequence=3&isAllowed=y, University of Waterloo, Waterloo, Ontario, Canada, Aug. 5, 2019, 161 pages.
Carceller et al., "New Folder Configuration of Rectangular Waveguide Filters with Asymmetrical Transmission Zeros", Proceedings of the 44th European Microwave Conf., Oct. 6-9, 2014, pp. 183-186.
Zhang et al., "Triple-Mode Dielectric-Loaded Cylindrical Cavity Diplexer Using Novel Packaging Technique for LTE Base-Station Applications", IEEE Transactions on Components, Packaging and Manufacturing, vol. 6, No. 3, Mar. 2016, pp. 383-389.
Bastioli S., et al., "A New Class of Waveguide Dual-Mode Filters Using TM and Non Resonating Modes," IEEE Transactions on Microwave Theory and Techniques, vol. 58, No. 12, Dec. 1, 2010, pp. 3909-3917.
Eskandari A.R. et al., "Improvement of Passband Flatness for a Compact, Narrowband, and Highly Selective TM Dual-Mode Filter," IEEE Transactions on Microwave Theory and Techniques, vol. 68, No. 4, Apr. 1, 2020, pp. 1591-1597.
European Search Report for European Application No. 22158198.6, dated Jul. 4, 2022, 11 pages.

* cited by examiner

WAVEGUIDE CROSS-COUPLING FILTER WITH MULTIPLE PARALLEL CAVITIES

BRIEF DESCRIPTION OF THE DRAWINGS

The accompanying drawings illustrate a number of exemplary embodiments and are a part of the specification. Together with the following description, these drawings demonstrate and explain various principles of the present disclosure.

Figure 1:
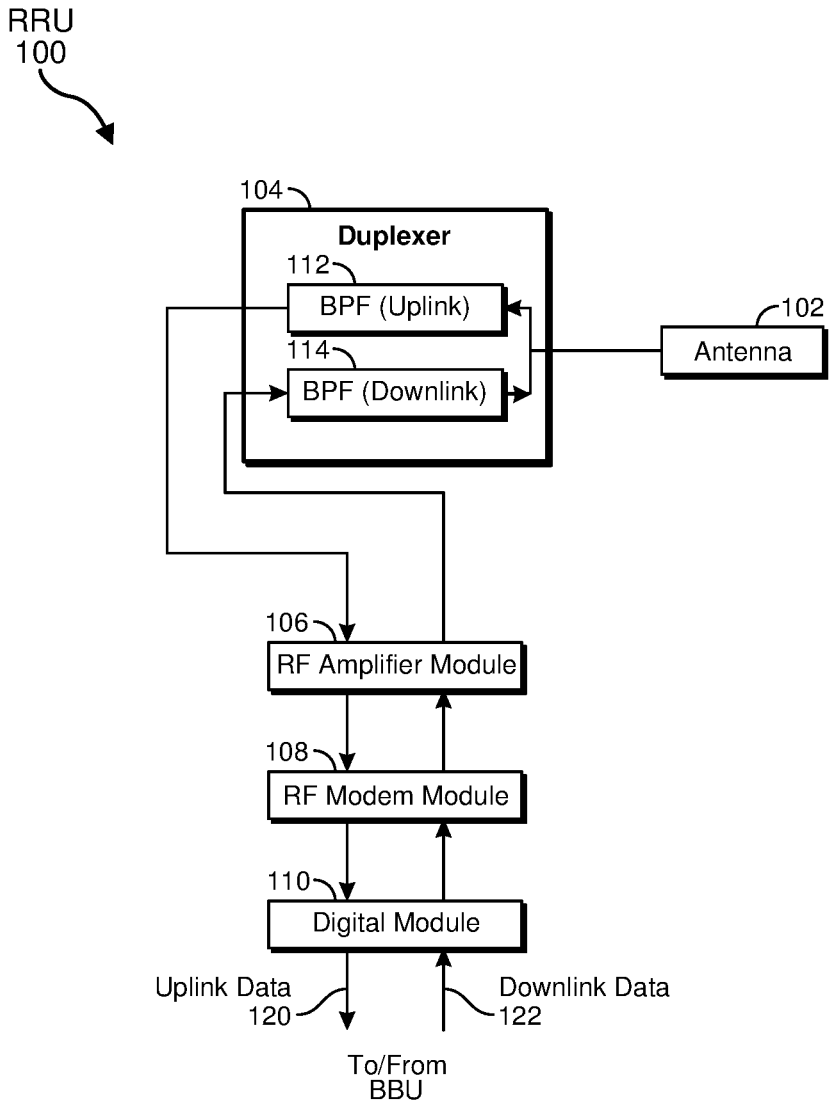
FIG. 1 is a block diagram of an exemplary remote radio unit (RRU) in which embodiments of an exemplary waveguide filter discussed below may be employed.

Throughout the drawings, identical reference characters and descriptions indicate similar, but not necessarily identical, elements. While the exemplary embodiments described herein are susceptible to various modifications and alternative forms, specific embodiments have been shown by way of example in the drawings and will be described in detail herein. However, the exemplary embodiments described herein are not intended to be limited to the particular forms disclosed. Rather, the present disclosure covers all modifications, equivalents, and alternatives falling within the scope of the appended claims.

DETAILED DESCRIPTION OF EXEMPLARY EMBODIMENTS

Many remote radio units (RRUs), such as those employed as macrocell or microcell base stations for cellular communications (e.g., 4G and/or 5G LTE (Long-Term Evolution) communications), include one or more radio frequency (RF) bandpass filters (BPFs) that pass signals of a particular wavelength band for transmission from the RRU (e.g., via a downlink channel) or for reception by the RRU (e.g., via an uplink channel). In some circumstances, such a filter may be configured to provide low in-band insertion loss, supply significant out-of-band rejection, and support a significantly high transmission power. Due to these characteristics, these RF bandpass filters are typically bulky and heavy (e.g., to dissipate heat and to provide the desired signal transfer characteristics).

In some implementations, the RF bandpass filter may be implemented by a plurality of cross-coupled cylindrical resonance cavities to generate a number of filter "poles" to create a high level of out-of-band rejection. This particular type of bandpass filter often requires a significant amount of time to manufacture (e.g., due to assembly and soldering of components). As this manufacturing process normally introduces a significant level of variation in the size and/or shape of the resonance cavities that may adversely affect the transfer characteristics of the filter, the bypass filter often includes a number of tuning screws that facilitate adjustment of those characteristics as desired. This tuning process often consumes a significant amount of time (e.g., a half-hour or more) of a highly trained field technician for each filter employed in the RRU.

The present disclosure is generally directed to an RF waveguide-based bandpass filter that defines a series of cross-coupled cavities that are stacked in parallel, side-by-side. As will be explained in greater detail below, such a filter may provide excellent out-of-band rejection and low in-band insertion and return losses without the use of screws or other tuning mechanisms, thus enhancing the manufacturability of the filter while reducing the deployment time typically associated with an RF bandpass filter.

Features from any of the embodiments described herein may be used in combination with one another in accordance with the general principles described herein. These and other embodiments, features, and advantages will be more fully understood upon reading the following detailed description in conjunction with the accompanying drawings and claims.

Figure 5:
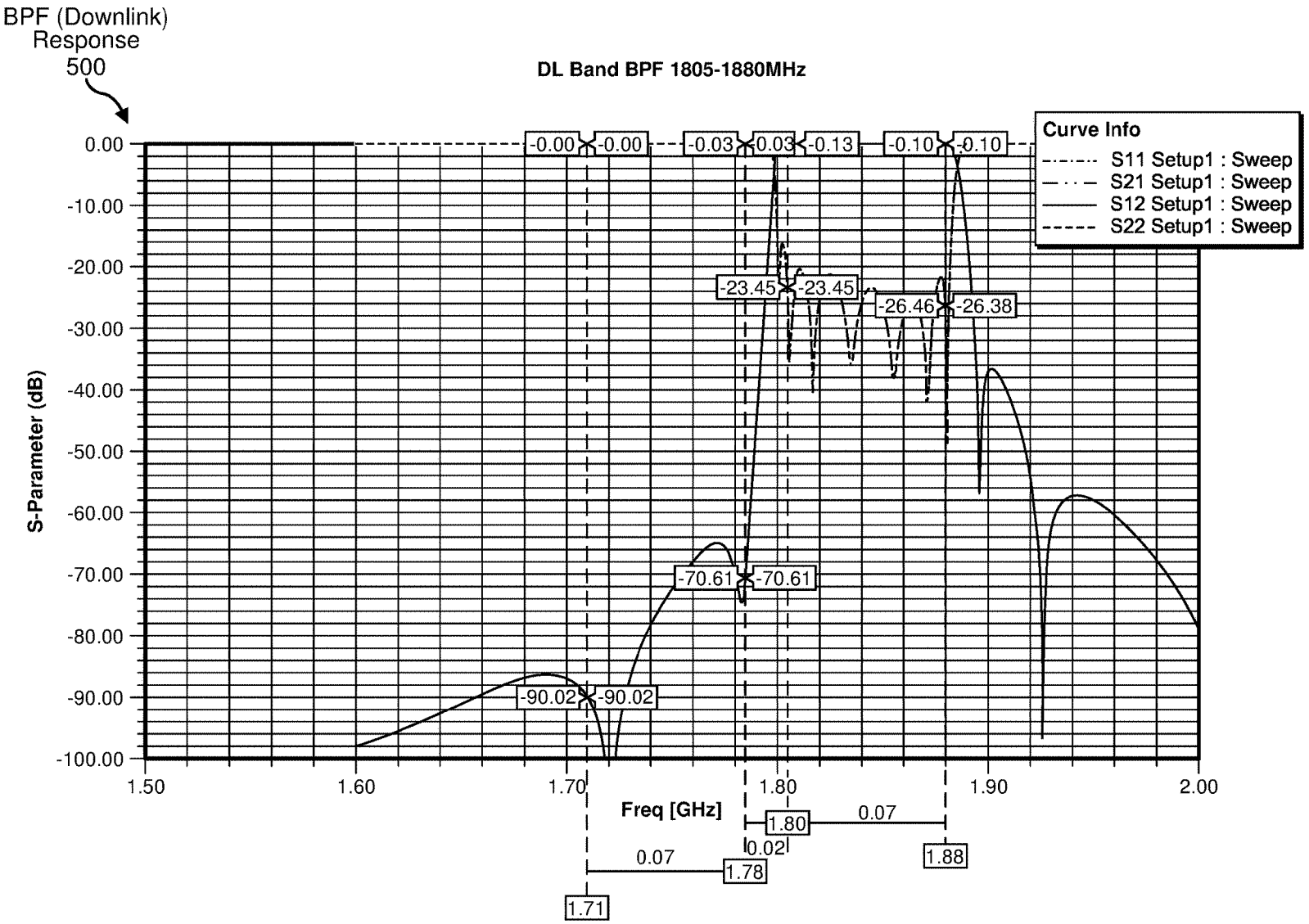
FIG. 5 is a graph depicting a frequency response of a simulation of a downlink version of the exemplary waveguide filter configuration of FIGS. 2-4.
Figure 6:
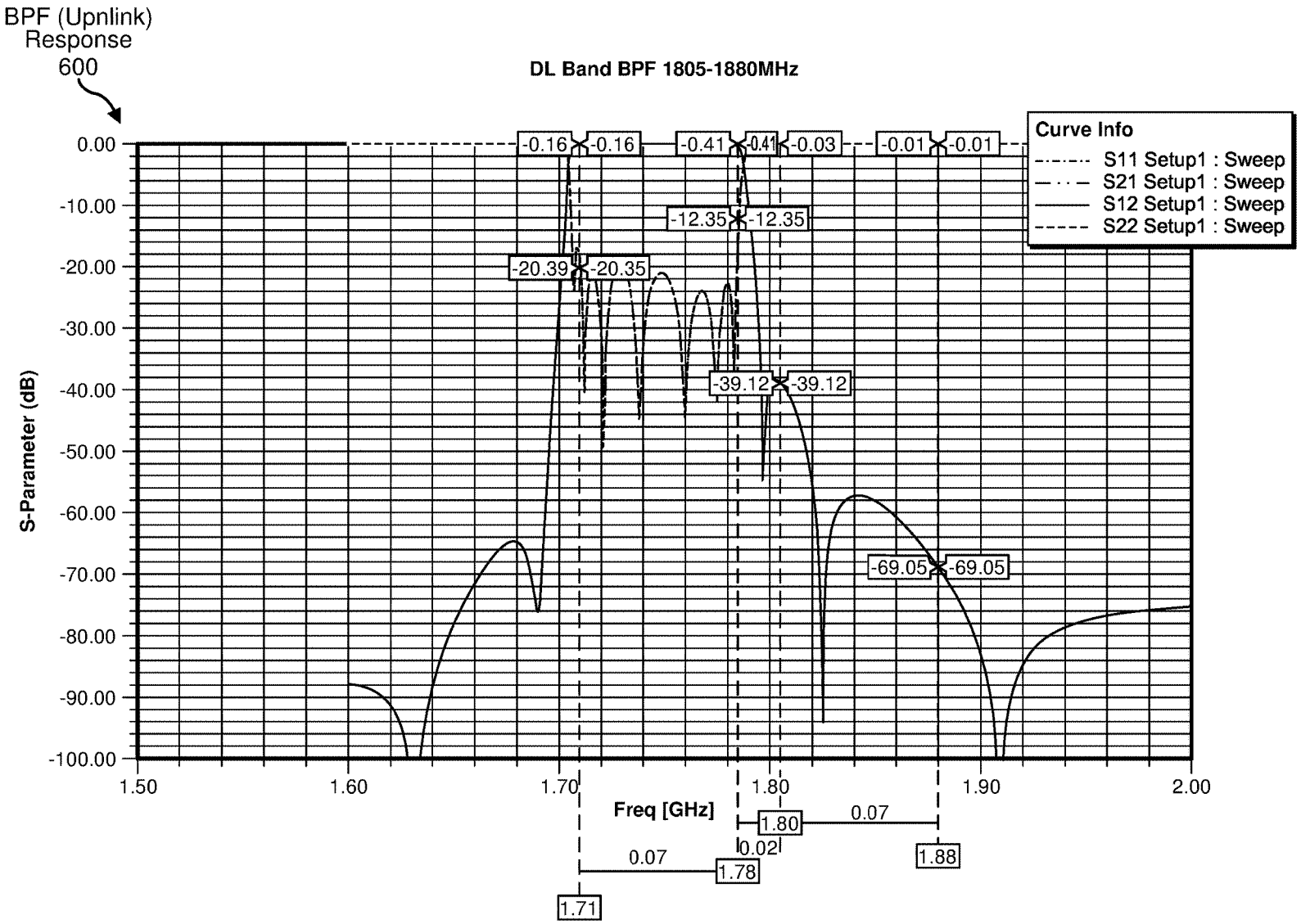
FIG. 6 is a graph depicting a frequency response of a simulation of an uplink version of the exemplary waveguide filter configuration of FIGS. 2-4.
Figure 7:
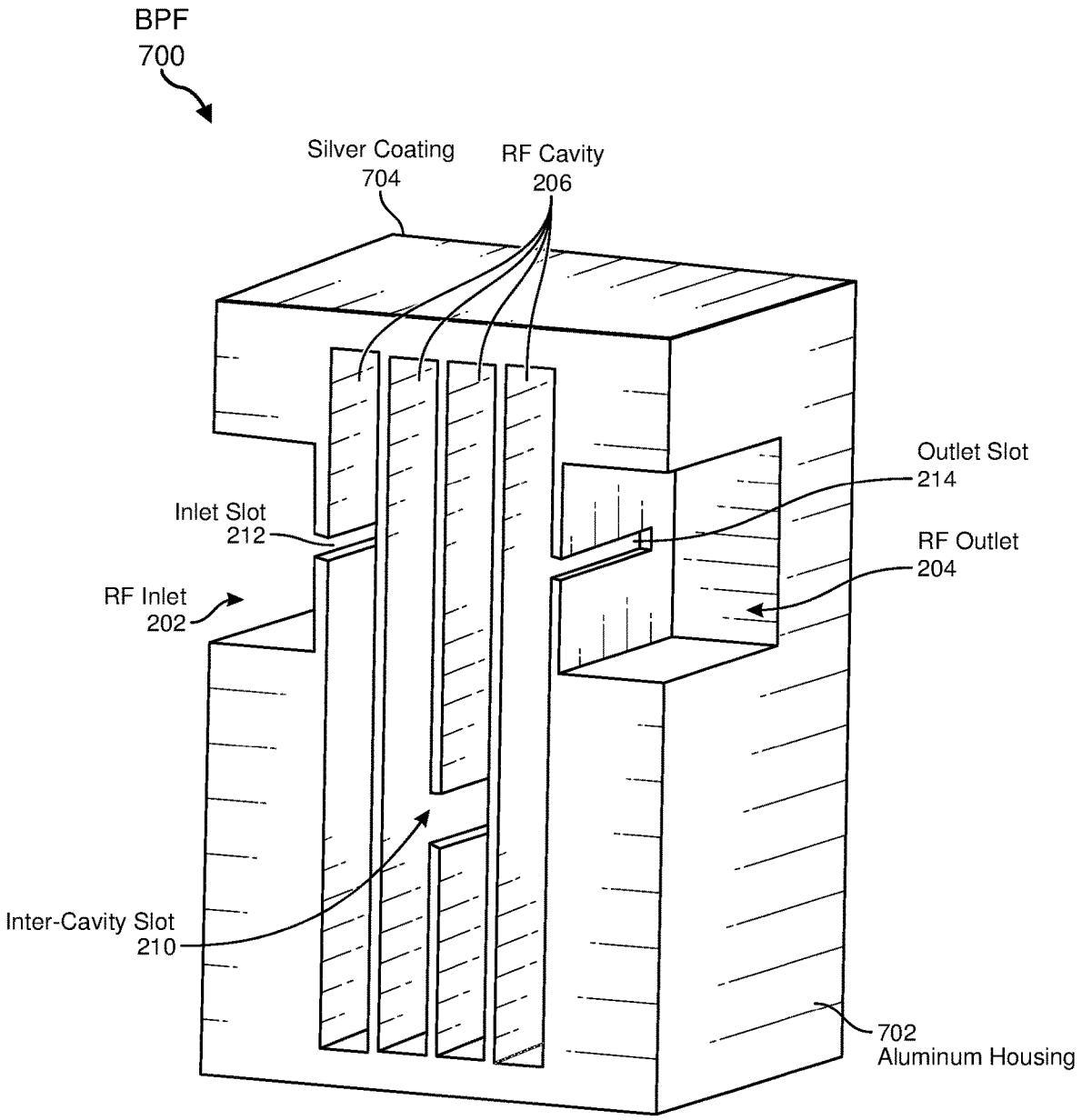
FIG. 7 is a perspective cross-section of an exemplary waveguide filter created from a monolithic metallic structure defining a plurality of air cavities.

The following will provide, with reference to FIGS. 1-12, detailed descriptions of exemplary waveguide filter configurations, associated waveguide bandpass filters, and related methods of manufacturing such filters. An example remote radio unit in which embodiments of an exemplary waveguide filter, as disclosed herein, may be employed is discussed in reference to FIG. 1. An exemplary waveguide filter configuration for use as a bandpass filter is described in connection with the various views of FIGS. 2-4, and an expected frequency response for separate uplink and downlink versions of the configuration are discussed in conjunction with FIGS. 5 and 6. With reference to FIG. 7, an exemplary waveguide filter created from a monolithic metallic structure is described, and another exemplary waveguide filter created from an assembly of metallic plates is explored in connection to FIGS. 8 and 9. An exemplary duplexer that employs a plurality of waveguide filters and that is manufactured from a dielectric material is described in conjunction with FIGS. 10 and 11. In associated with FIG. 12, an exemplary waveguide filter that is manufactured from a plurality of modular components of a dielectric material is described.

FIG. 1 is a block diagram of an exemplary RRU 100 in which embodiments of an exemplary RF bandpass filter, as described in greater detail below, may be implemented. As shown, RRU 100 may include an antenna 102, a duplexer 104, an RF amplifier module 106, an RF modulator/demodulator (modem) module 108, and a digital module 110. In some examples, RRU 100 may exchange uplink data 120 (e.g., data received wireless by RRU 100 from a mobile device, such as a smartphone) and/or downlink data 122 (e.g., data to be transmitted wirelessly from RRU 100 to a mobile device) via digital module 110 with a baseband unit (BBU) that may be communicatively coupled to a backhaul network coupled to other BBUs and/or other communication systems. More specifically, in some embodiments, for downlink data 122, digital module 110 may employ a digital encoder, a data serializer, and/or other circuitry to convert downlink data 122 into a usable form for RF modem module 108. Further, digital module 110 may include a digital decoder, a data deserializer, and/or other circuitry to convert digital data received from RF modem module 108 to produce uplink data 120 that may be received and processed further at the BBU.

In some embodiments, RF modem module 108 may include a digital-to-analog converter (DAC) that converts digital data from digital module 110 derived from downlink data 122 to an analog signal that may then be modulated according to a wireless transmission protocol to produce an RF signal carrying downlink data 122 (e.g., an RF signal in a 4G or 5G LTE DCS (Digital Communication System) "B3" downlink wavelength band). The modulated analog RF signal may then be provided to RF amplifier module 106 that may amplify the RF signal for downlink data 122 prior to forwarding that signal to duplexer 104. Further, RF amplifier module 106 may amplify an RF signal carrying uplink data 120 (e.g., an RF signal in a 4G or 5G LTE DCS "B3" uplink wavelength band) that is received from duplexer 104 and may forward that amplified signal to RF modem module 108. Additionally, RF modem module 108 may include a demodulator that demodulates the RF signal, and then converts the resulting analog signal (e.g., using an analog-to-digital converter (ADC)) to produce corresponding digital data representing uplink data 120 to digital module 110.

Duplexer 104, in some embodiments, may include an RF bandpass filter 112 for uplink data 120 and a separate RF bandpass filter 114 for downlink data 122. For example, RF bandpass filter 112 may filter RF signals received via antenna 102 outside of an uplink wavelength band (e.g., the LTE DCS "B3" uplink wavelength band), while RF bandpass filter 114 may filter RF signals received from RF amplifier module 106 outside of a downlink wavelength band (e.g., the LTE DCS "B3" downlink wavelength band). Further, duplexer 104 may operate as a three-port device that receives the RF signal carrying downlink data 122 via a first port and forwards a filtered version of that RF signal by way of a second port to antenna 102 while simultaneously receiving an RF signal carrying uplink data from antenna 102 at the second port and filtering that RF signal at RF bandpass filter 112 for output to RF amplifier module 106 via a third port. Consequently, duplexer 104 may allow the use of a single antenna 102 for full duplex communication by facilitating RF signal transmission and reception over separate, but associated, wavelength bands.

While transmission and reception bands for a single full duplex communication channel are discussed above in conjunction with RRU 100, other embodiments of RRU 100 may service multiple such channels. Consequently, in some examples, RRU 100 may include multiple antennas 102, duplexers 104, and other modules described above to provide multichannel communication ability.

Figure 2:
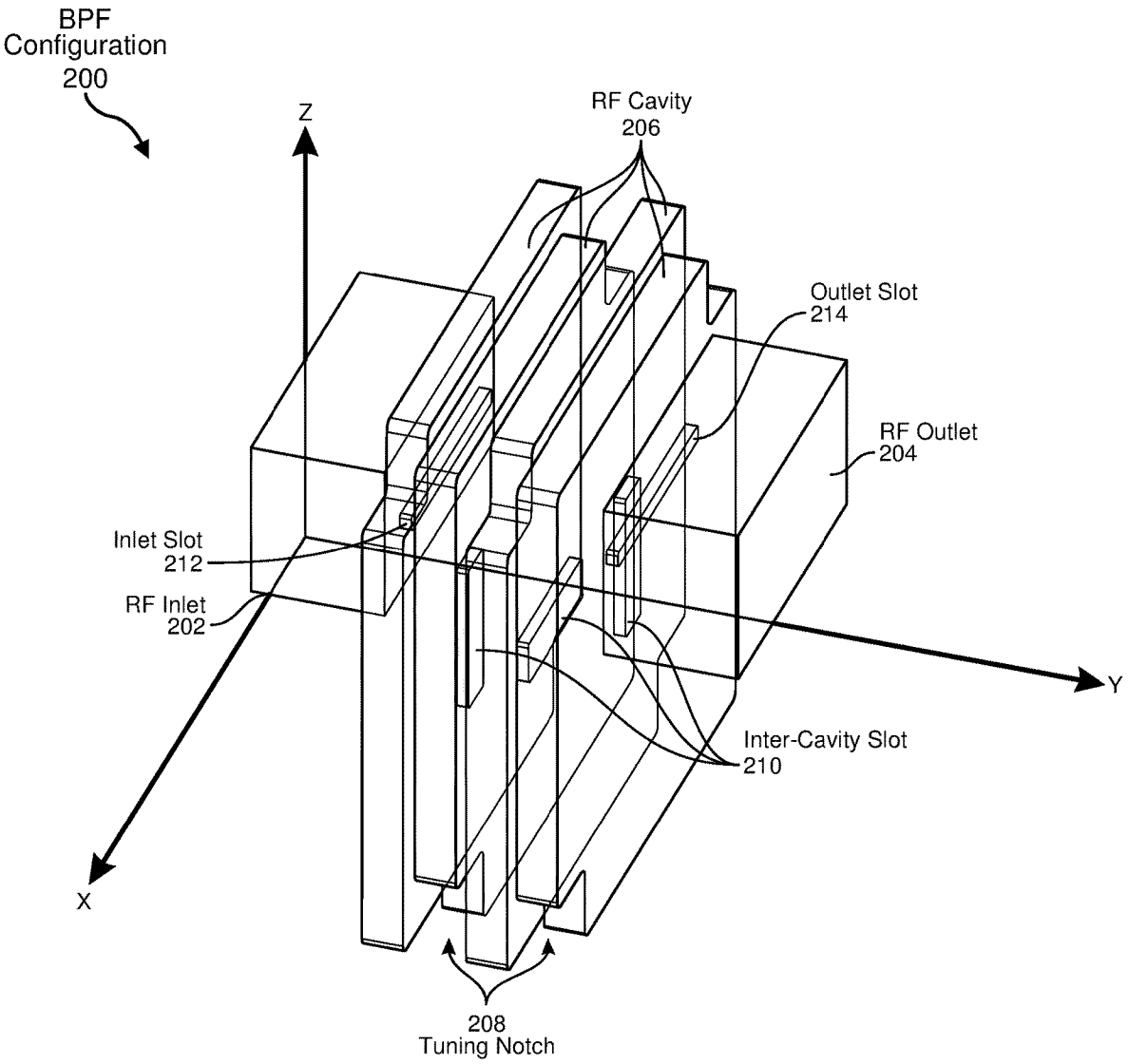
FIG. 2, FIG. 3, and FIG. 4 are a perspective view, a side view, and an end view, respectively, of an exemplary waveguide filter configuration for operation as a bandpass filter.
Figure 3:
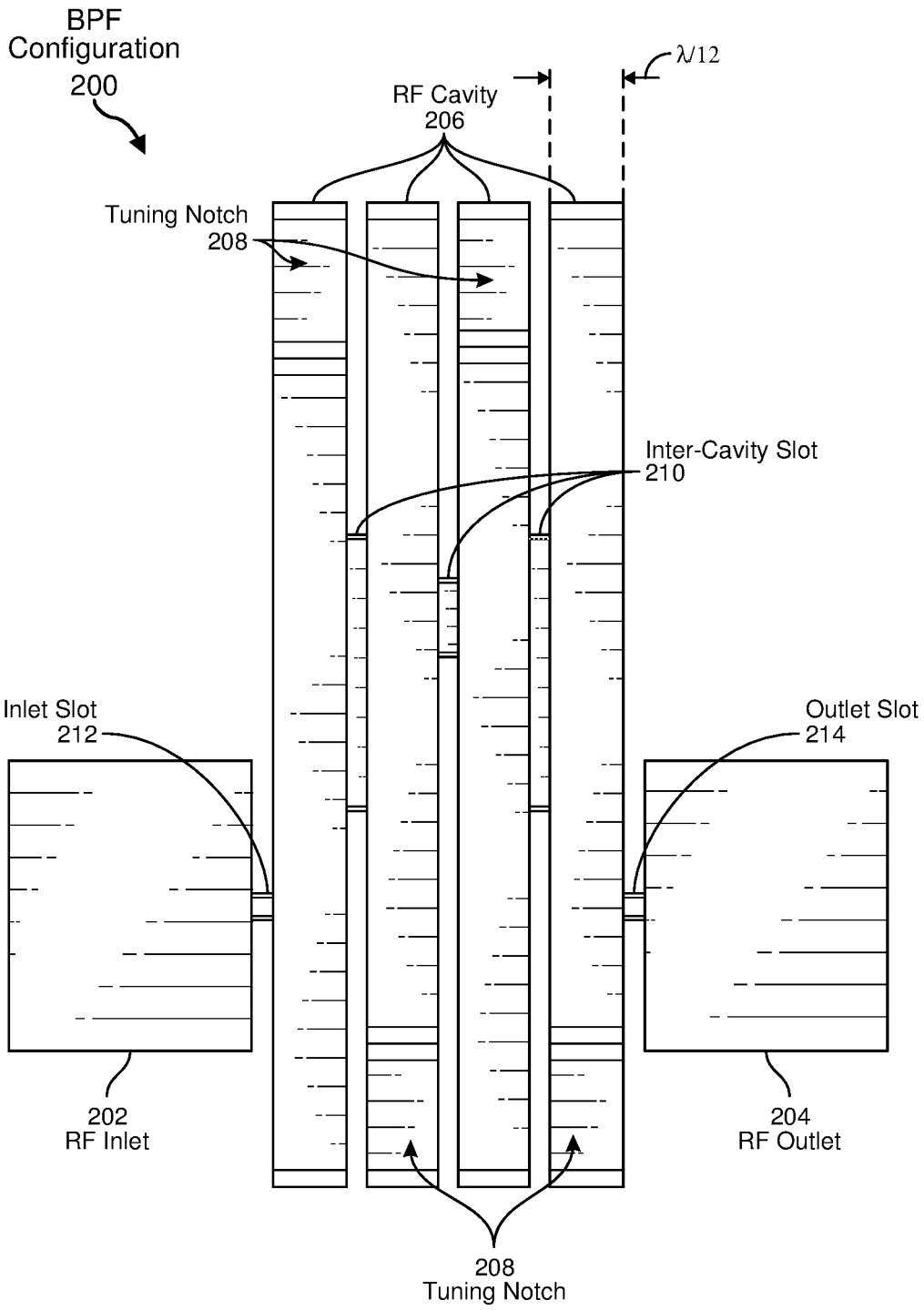
Figure 4:
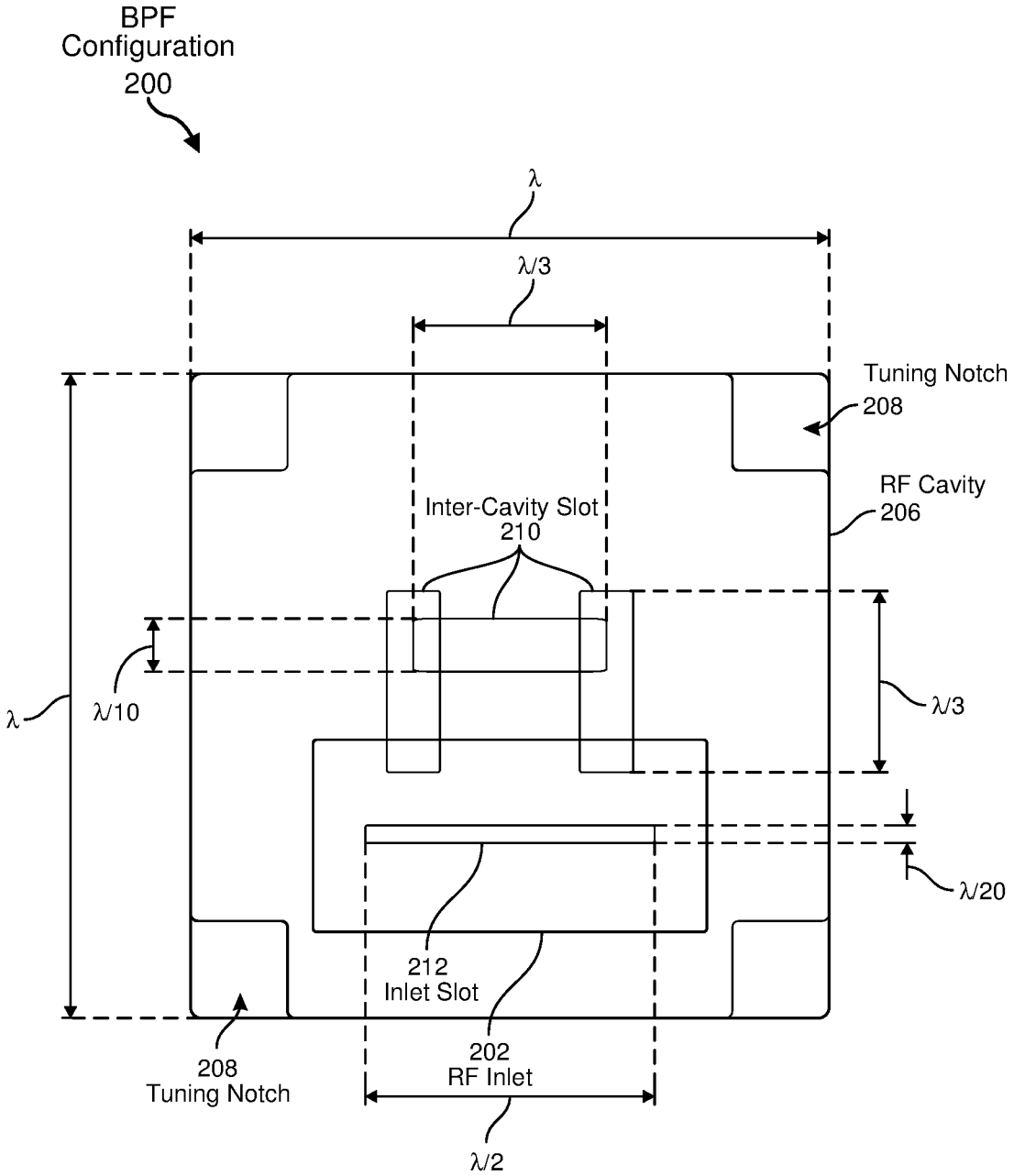

FIGS. 2-4 provide various views of an exemplary waveguide filter configuration (specifically a bandpass filter (BPF) configuration 200) that may result in a more easily manufactured and deployed RF signal filter relative to more conventional filters, such as those typically employed as BPFs 112 and 114 in RRU 100. More specifically, FIG. 2 is a perspective view, FIG. 3 is a side view, and FIG. 4 is an end view of BPF configuration 200. As shown, BPF configuration 200 may include a series of RF "cavities" within which an RF signal propagates as the signal is filtered. In some examples, as described below, these cavities may be air-filled voids defined within one or more metallic structures. In yet other embodiments, the cavities may be a dielectric material (e.g., a dielectric material having a dielectric constant greater than the dielectric constant of air of approximately one) that may or may not be encased in, or otherwise supported by, a surrounding structure.

As illustrated in FIGS. 2-4, BPF configuration 200 may include a plurality of RF cavities 206 that are aligned in a series in parallel along a major axis (e.g., a y-axis of FIG. 2), where each adjacent pair of cavities 206 are coupled by a corresponding inter-cavity slot 210 by which an RF signal may pass from one cavity 206 to another. Further, each RF cavity 206 may generally include a plurality of planar surfaces that define a first dimension aligned with the major axis (e.g., the y-axis of FIG. 2), as well as a second dimension (e.g., aligned along an x-axis of FIG. 2) and a third dimension (e.g., aligned along a z-axis of FIG. 2) such that the second and third dimensions are aligned perpendicular to the major axis and each other. Further, in some embodiments, such as that depicted in FIGS. 2-4, the first dimension of each cavity 206 is shorter that the second dimension and the third dimension. Additionally, in some embodiments, as illustrated in FIGS. 3 and 4, the first dimension of each cavity 206 may be approximately one-twelfth of the wavelength $\lambda$ (e.g., $\lambda/12$) of a wavelength of the RF signal to be passed by BPF configuration 200, and the second and third dimensions may be approximately equal to wavelength A. Consequently, each cavity 206 may be characterized as approximating a narrow rectangular cuboid. Additionally, each two or more cavities 206 may possess slightly different first, second, and third dimensions based on different values of wavelength $\lambda$ associated with the bandwidth to be passed by BPF configuration 200 (e.g., a resonance frequency associated with cavity 206). As shown in FIG. 3, for example, cavities 206 at opposing ends of BPF configuration 200 may be slightly larger along the second and third dimensions than cavities 206 positioned therebetween. In the example of FIGS. 2-4, BPF configuration 200 may include four cavities 206, resulting in a four-pole filter structure. However, other numbers of cavities 206 (e.g., eight cavities 206, 16 cavities 206, and the like) may be used in other examples.

Each cavity 206, in some embodiments, may include at least one tuning "notch" 208 that essentially occupies, fills, or walls off a corner of cavity 206. In the example of FIG. 2, each cavity 206 may include two tuning notches 208 representing cuboids located at diagonally opposing corner regions of cavity 206. In some examples, in a plane defined by the second and third dimensions of cavity 206 (e.g., in the x-z plane of FIG. 2), each tuning notch 208 may generally describe a square. Further, in some embodiments, each successive cavity 206 along the major axis may include tuning notches 208 at alternating opposing corners of each cavity 206. For example, a first cavity 206 may include a tuning notch 208 at each of a first corner region and an opposing second corner region, while another cavity 206 adjacent first cavity 206 may include a tuning notch 208 at each of a third corner region and an opposing fourth corner region that do not align along the major axis with the first and second corner regions of first cavity 206. In some examples, the corner locations of tuning notches 208 of each cavity 206 alternate in such a fashion along BFP configuration 200. In some embodiments, tuning notches 208 may be sized along the second and third dimensions of corresponding cavity 206 to adjust an RF signal bandwidth associated with cavity 206.

Inter-cavity slots 210 positioned between adjacent cavities 206, as shown most prominently in FIG. 4, may be sized, shaped, and positioned relative to each other to create a zero transition between each pair of adjacent cavities 206. As discussed in greater detail below, each zero transition may be associated with a particular frequency that defines the overall bandwidth of the signals to be passed by BPF configuration 200. In some embodiments, as shown in FIG. 4, each inter-cavity slot 210, as viewed along the major axis, may be shaped as a rectangle. Further, in some examples, each inter-cavity slot 210 may possess a length of a third of a wavelength (e.g., $\lambda/3$) and a width of a tenth of a wavelength (e.g., $\lambda/10$) to be passed by BFP configuration 200. Additionally, when proceeding from one end of BPF configuration 200 to the other, each inter-cavity slot 210 encountered between consecutive cavities 206 may be oriented 90 degrees relative to the immediately preceding and/or subsequent inter-cavity slot 210.

Further, in some embodiments, as viewed along the major axis, as depicted in FIG. 4, each inter-cavity slot 210 may overlap a portion of the immediately preceding and/or subsequent inter-cavity slot 210, with each overlap creating an associated zero transition. In the particular example of FIGS. 2-4, three inter-cavity slots 210 are defined, where opposing ends of a second inter-cavity slot 210 positioned between a first inter-cavity slot 210 and a third inter-cavity slot 210 overlap a portion of the first and third inter-cavity slots 210 (e.g., extending halfway into the width of both the first and third inter-cavity slots 210). However, other overlap configurations of consecutive inter-cavity slots 210 (e.g., overlapping corners of consecutive inter-cavity slots 210) may be used in other embodiments. Each such overlap may be configured, in some examples, to tune a resonance frequency associated with a zero-transition corresponding with that overlap.

To direct an RF signal into one end of BPF configuration 200 and produce a resulting filtered RF signal from BPF configuration 200, an RF inlet 202 may be provided to direct the incoming RF signal to a first cavity 206 by way of an inlet slot 212. Further, the filtered RF signal may be directed from a last cavity 206 by way of an outlet slot 214 to an RF outlet 204. In the particular example of FIGS. 2-4, inlet slot 212 and/or outlet slot 214, as viewed along the major axis, may be rectangular in nature, with dimensions of one-half of a wavelength (e.g., $\lambda/2$) by one-twentieth of a wavelength (e.g., $\lambda/20$) associated with the bandwidth of the RF signal to be passed by BPF configuration 200. Further, inlet slot 212 and/or outlet slot 214 may be oriented orthogonal to the nearest inter-cavity slot 210 of BPF configuration 200. Additionally, as indicated in FIG. 4, inlet slot 212 and/or outlet slot 214 may be centrally located along one side of corresponding RF inlet 202 and/or RF outlet 204. In some embodiments, RF inlet 202 and/or RF outlet 204 may be shaped as a rectangular cuboid, and/or may be configured to facilitate coupling with another waveguide component (e.g., an RF connector, such as an SMA (Sub-Miniature version A) connector, an SMP (Sub-Miniature Push-on) connector, an N-type connector, a DIN connector, and so on) for receiving and providing an RF signal.

In operation, BPFs employing BPF configuration 200 may receive an RF signal to be filters via RF inlet 202 and inlet slot 212, through which the RF signal propagates into a first RF cavity 206 adjacent RF inlet 202. In at least some examples, due to the size and orientation of cavity 206, the RF signal may propagate within cavity 206 as a transverse electromagnetic mode (TEM) signal. As the RF signal passes through each cavity 206 by way of inlet slot 212, inter-cavity slots 210 (e.g., numbering three in BPF configuration 200), and outlet slot 214, with each slot oriented perpendicularly to an immediately preceding and subsequent slot, the zero transitions of BPF configuration 200 relating to the slots may impose the desired high out-of-band rejection on the RF signal.

FIG. 5 and FIG. 6 are graphs depicting frequency responses of a simulation of two separate BPFs for two different frequency bands dimensioned and arranged according to BPF configuration 200. More specifically, FIG. 5 is a graph of the frequency response for a downlink BPF, such as downlink BPF 114 for the LTE B3 downlink wavelength band of 1805-1880 megahertz (MHz), and FIG. 6 is a graph of the frequency response of a simulation of an uplink BPF (e.g., uplink BPF 112 for the LTE B3 uplink wavelength band of 1710-1785 MHz). As illustrated in FIGS. 5 and 6, the associated BPF patterned after BPF configuration 200 may provide S-parameter gain from RF inlet 202 to RF outlet 204 (e.g., denoted in FIGS. 5 and 6 as S21, representing an insertion loss for BPFs 112 and 114) of only slightly greater than 0.2 decibels (dB), thus passing substantially all RF energy within the desired passband, while providing strong rejection outside the desired passband. In the case of FIG. 5, the zero transitions provided by inter-cavity slots 210, as described above, may result in the low S-parameter gain "valleys" (e.g., as low as approximately −100 dB) at 1720 MHz, 1780 MHz, 1896 MHz, and 1926 MHz, resulting in a steep falloff in gain outside the desired passband (e.g., approximately 70 dB rejection in the corresponding uplink band). Similarly, in FIG. 6, low S-parameter gain levels are indicated at 1630 MHz, 1690 MHz, 1788 MHz, 1836 MHz, and 1910 MHz (e.g., resulting in approximately 40 dB rejection in the associated downlink band). While such performance is attainable using a four-pole filter design, as depicted in FIGS. 2-4, steeper out-of-band rejection may be attained in some embodiments by increasing the number of zero transitions and associated cavities 206, such as by way of coupling two BPFs arranged according to BPF configuration 200 end-to-end, resulting in two four-pole filters cascaded. In yet other embodiments, additional poles may be generated by directly adding four RF cavities 206 and associated inter-cavity slots 210 to BPF configuration 200 to create a single eight-pole filter.

While particular reference is made herein to embodiments of BPF configuration 200 directed to LTE B3 uplink and downlink applications, BPF configuration 200 may be applied to other frequencies and frequency bands. In some examples, BPF configuration 200 may be configured to pass any frequency below 8 GHz and may provide a passband having a bandwidth of less than 30% of the frequency to be passed.

As discussed above, BPF configuration 200 may be implemented in various ways. FIG. 7 is a perspective cross-section of an exemplary waveguide BPF 700 created from a monolithic metallic structure defining a plurality of air cavities. More specifically, a monolithic aluminum housing 702 (e.g., a 6061-type precipitation-hardened aluminum alloy) may be processed (e.g., machined, cast, or the like) to form RF cavities 206, inter-cavity slots 210, RF inlet 202 with inlet slot 212, and RF outlet 204 with outlet slot 214, as described above, to produce BPF 700. Further, an exterior of aluminum housing 702 may be coated with a silver coating 704 (e.g., to provide solderability to the external surface of BPF 700 for shielding purposes, to reduce insertion loss of BPF 700, and/or the like). In an example in which BPF 700 is configured as an LTE B3 uplink BPF 112 or downlink BPF 114, BPF 700 may be approximately 203-by-204-by-130 millimeters (mm) in size. While silver is explicitly indicated in BPF 700, other types of conductor coatings, such as palladium, copper, and so on, may be employed in other examples.

Figure 8:
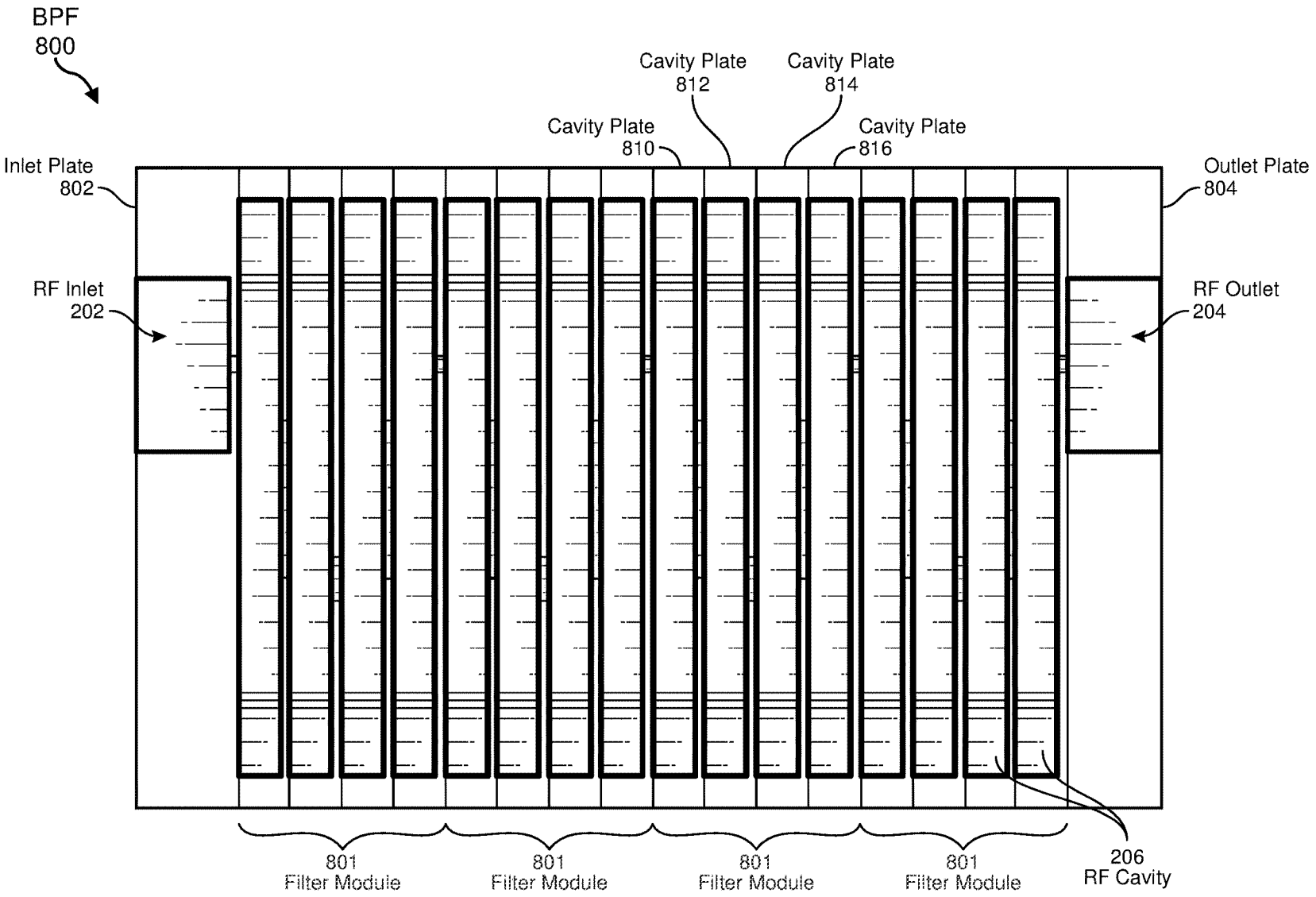
FIG. 8 is a side cross-section of another exemplary waveguide filter created from an assembly of metallic plates.
Figure 9:
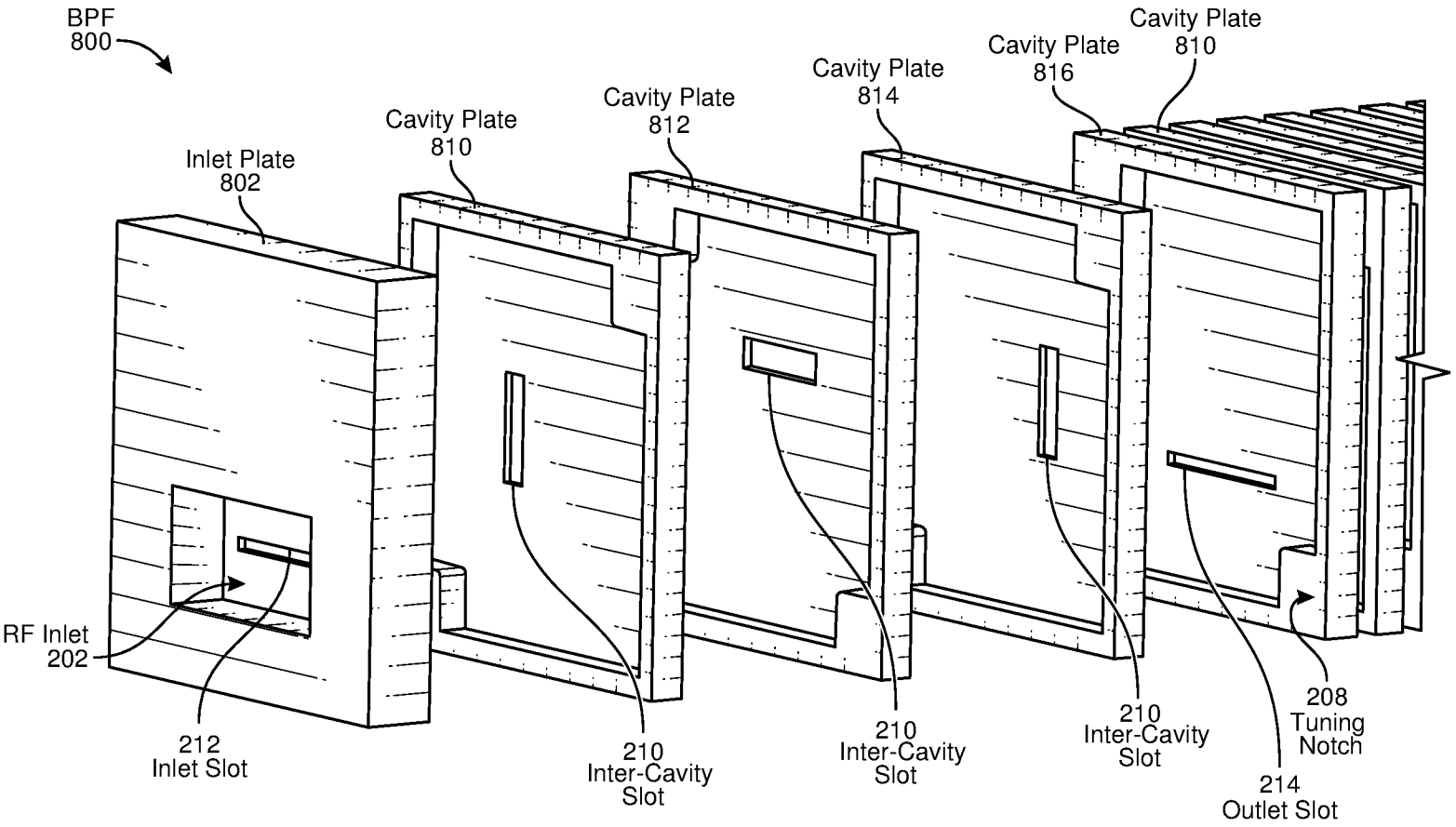
FIG. 9 is an exploded perspective view of the waveguide filter of FIG. 8.

FIGS. 8 and 9 depict a BPF 800 employing a 16-pole design, in which four BPF configurations 200 may be employed end-to-end, with intermediate RF inlet 202 and RF outlet 204 omitted. More specifically, FIG. 8 is a side cross-section of BPF 800, and FIG. 9 is an exploded perspective view of BPF 800. Instead of employing a monolithic metallic structure, as discussed above in connection with FIG. 7, BPF 800, as shown in FIGS. 8 and 9, may be created from an assembly of individual metallic plates coupled (e.g., bolted) side-by-side. Each plate may be machined, cast, and/or the like. In some embodiments, BPF 800 may include four substantially identical filter modules 801, with each filter module 801 including a first cavity plate 810 defining a first RF cavity 206 and associated inter-cavity slot 210, a second cavity plate 812 defining a second RF cavity 206 and associated inter-cavity slot 210, a third cavity plate 814 defining a third RF cavity 206 and associated inter-cavity slot 210, and a fourth cavity plate 816 defining a fourth RF cavity 206 and an outlet slot 214, where each filter module 801 may be configured as an instance of BPF configuration 200. Moreover, attached to a first of filter modules 801 may be an inlet plate 802 defining an RF inlet 202 and corresponding inlet slot 212, and attached to a last of filter modules 801 may be an outlet plate 804 defining an RF outlet 204. Such a design may facilitate a simple, cost-effective, and repeatable manufacturing and assembly process for BPF 800. Also, in some examples, use of BPF 800 for one of the LTE B3 band filters (e.g., uplink BPF 112 or downlink BPF 114) may result in overall dimensions for BPF 800 of 203-by-204-by-330 mm.

As mentioned above, other waveguide media aside from air may be employed as RF inlet 202, inlet slot 212, cavities 206, inter-cavity slots 210, outlet slot 214, and RF outlet 204 of BPF configuration 200. For example, while air possesses a dielectric constant (or relative permittivity $\varepsilon_r$) of approximately one, use of another material (e.g., a ceramic) having a dielectric constant significantly greater than one results in a reduction in the physical wavelength of the RF signal having the same frequency (e.g., by the reciprocal of the square root of the dielectric constant), which may result in a corresponding reduction in the size of the resulting BPF incorporating that material in all three dimensions. Such reduction may not only be advantageous for installation as separate uplink BPF 112 and downlink BPF 114 in a communication system but may also facilitate a compact duplexer that combines uplink BPF 112 and downlink BPF 114.

Figure 10:
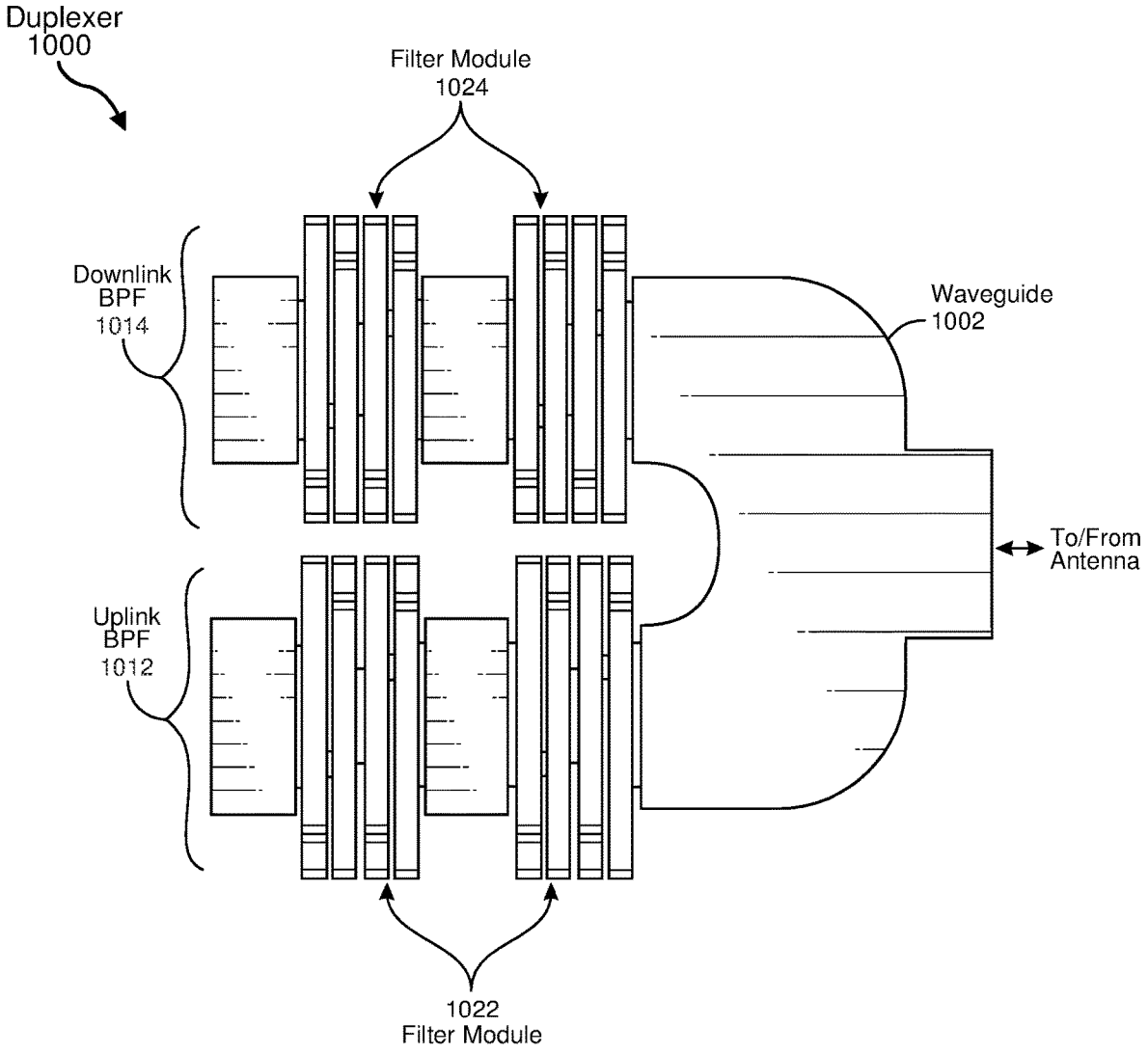
FIGS. 10 and 11 are a side view and an end view, respectively, of an exemplary duplexer that is manufactured from a dielectric material and employs a plurality of waveguide filters.
Figure 11:
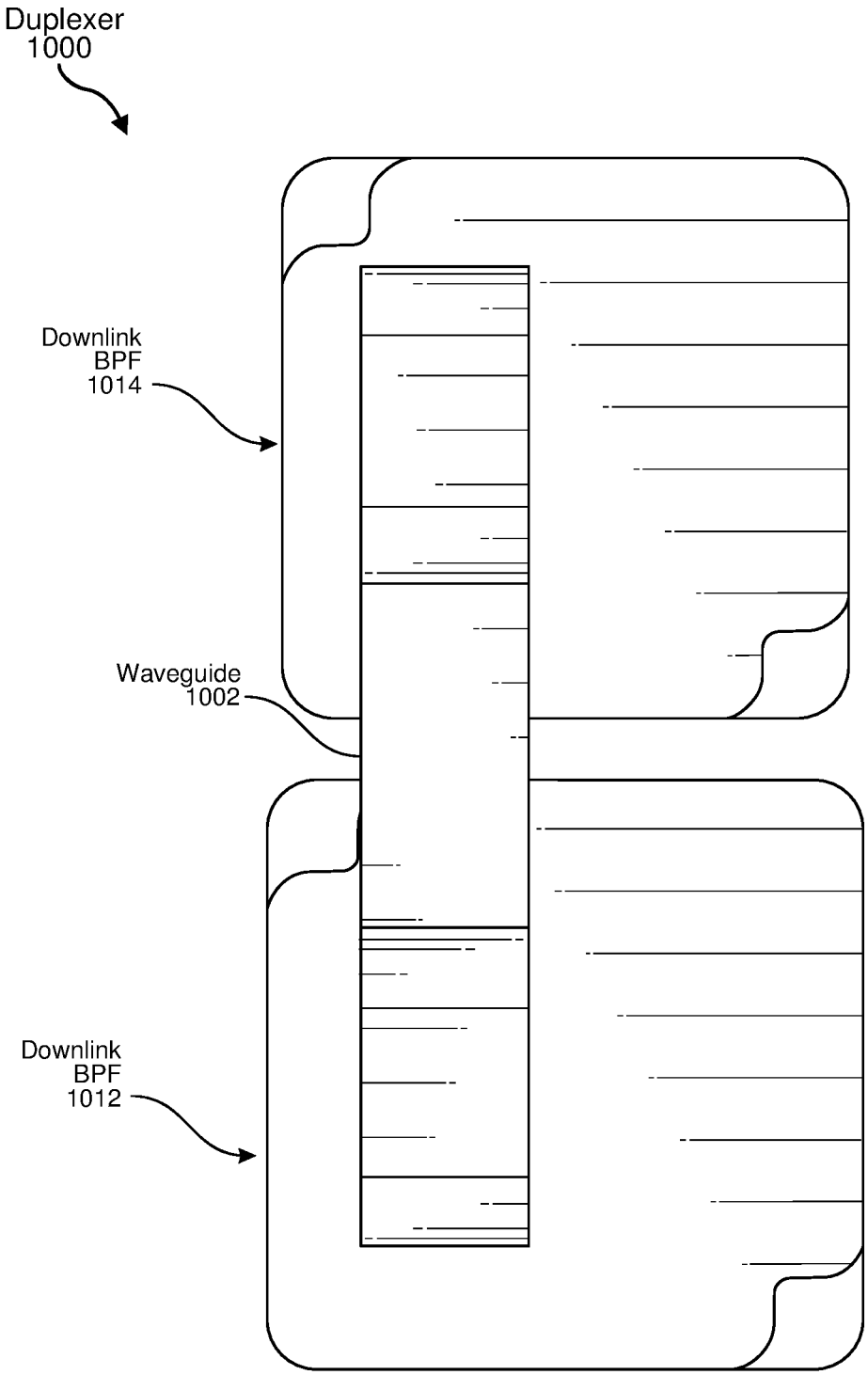

FIGS. 10 and 11 are a side view and an end view, respectively, of an exemplary duplexer 1000 that may be manufactured from a dielectric material (e.g., a ceramic) and may employ a plurality of waveguide filters. As shown, duplexer 1000 may include an uplink BPF 1012 and a downlink BPF 1014, both of which may be coupled by way of a waveguide 1002 to an antenna (not shown in FIGS. 10 and 11). In operation, RF downlink signals (e.g., from an RF amplifier module 106) may be provided (e.g., via a waveguide, cable, or other RF signal transmission medium) to downlink BPF 1014 for filtering prior to providing the RF signal via waveguide 1002 to the antenna for transmission. Simultaneously, the antenna may receive an RF uplink signal and direct that signal via waveguide 1002 to uplink BPF 1012 for filtering prior to amplification (e.g., via RF amplifier module 106).

Further, to impose a high level of out-of-band rejection in both uplink BPF 1012 and downlink BPF 1014, each BPF may employ dual (and possibly identical) filter modules, each of which may be configured to its particular passband according to BPF configuration 200: two filter modules 1022 for uplink BPF 1012 and two filter modules 1024 for downlink BPF 1014. Consequently, presuming duplexer 1000 is to be deployed for the LTE B3 uplink and downlink bands, use of air-filled cavities for all four filter modules 1022 and 1024 and waveguide 1002 may result in a significantly large duplexer 1000 (e.g., several times larger than BPF 700 of FIG. 7). However, in one example, by employing a ceramic for the various cavities with a dielectric constant of approximately 34 to construct duplexer 1000, the overall size of duplexer 1000 may be limited to approximately 76-by-90-by-38 mm.

In some embodiments, the ceramic material constituting the cavities of duplexer 1000, as shown in FIGS. 10 and 11, may be subsequently coated with silver (e.g., as mentioned above with respect to BPF 700 of FIG. 7) or another metal to provide an RF boundary for the ceramic material, as well as to provide an environmental barrier and/or a solderable surface. Moreover, in some examples, portions of duplexer 1000 may incorporate one or more additional mechanical features (e.g., flanges, holes, etc.) for manufacturing and assembly of duplexer 1000.

Figure 12:
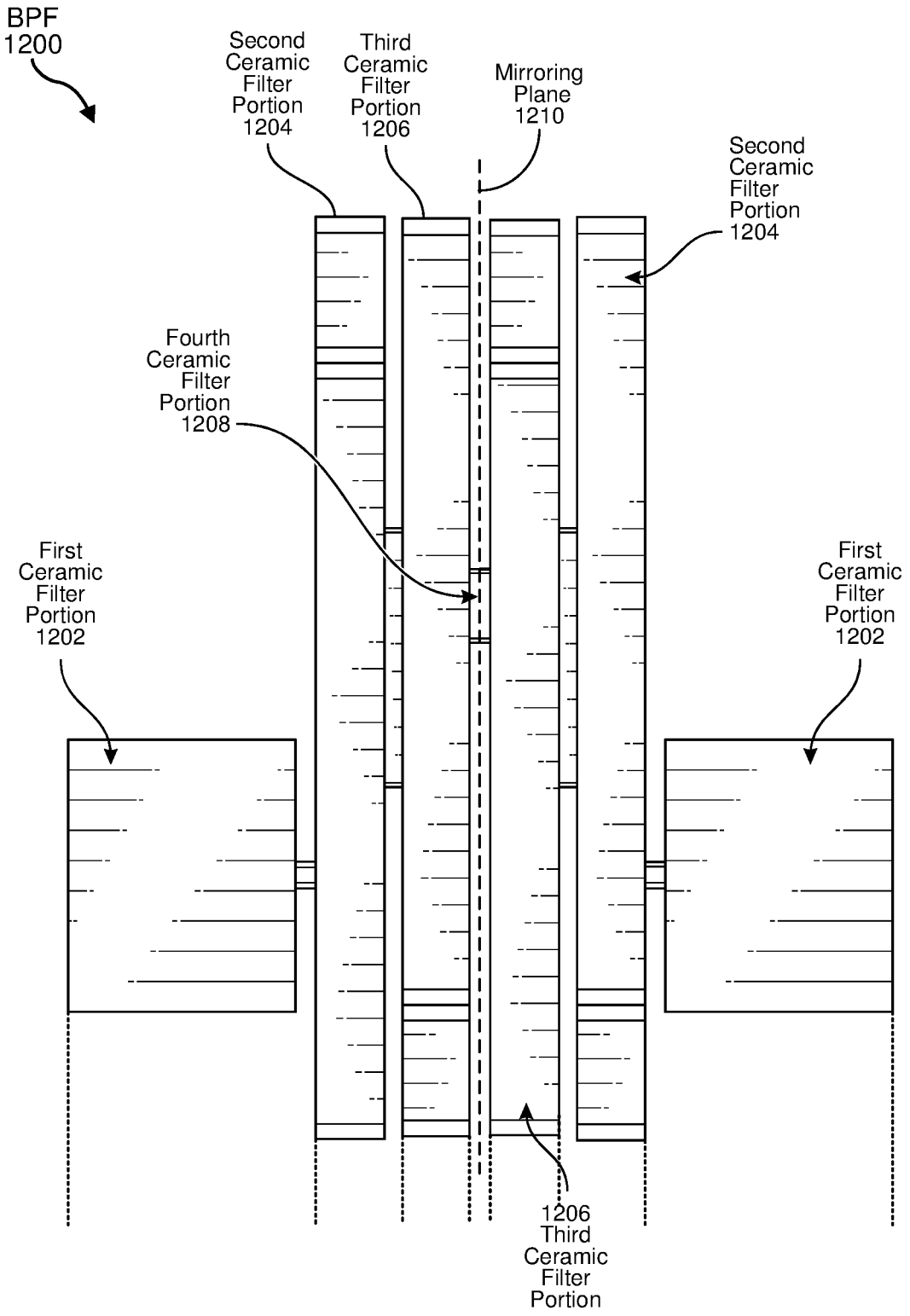
FIG. 12 is a side view of an exemplary waveguide filter that is manufactured from a plurality of modular components of a dielectric material.

While in some embodiments duplexer 1000 can be machined from a single monolithic ceramic structure, duplexer 1000 may include a plurality of ceramic portions that are coupled together to form a BPF according to BPF configuration 200. FIG. 12, for example, is a side view of an exemplary BPF 1200 manufactured from a plurality of modular components or portions of a dielectric material (e.g., a ceramic). In some examples, BPF 1200 may include four different shapes or portions of ceramic material: a first ceramic filter portion 1202, a second ceramic filter portion 1204, a third ceramic filter portion 1206, and a fourth ceramic filter portion 1208.

As organized in the embodiment of FIG. 12, as indicated by dashed lines therein, first ceramic filter portion 1202 may include an inlet/outlet and associated slot (e.g., a horizontal inlet/outlet slot), which may serve as RF inlet 202 in combination with inlet slot 212, or RF outlet 204 in combination of outlet slot 214). Second ceramic filter portion 1204 may be shaped as a first RF cavity 206 in combination with an associated inter-cavity slot 210 (e.g., a vertical inter-cavity slot 210). Third ceramic filter portion 1206 may include a second RF cavity 206 (e.g., an RF cavity 206 that may be coupled to a previous cavity 206 by a vertical inter-cavity slot 210). Fourth ceramic filter portion 1208 may be another inter-cavity slot 210 (e.g., a horizontal inter-cavity slot 210). In some embodiments, one or more portions may be created using metallic discs (e.g., discs of copper, aluminum, or the like) filled with ceramic material to create the slots.

As depicted in FIG. 12, BPF 1200 is a four-pole filter, as provided in BPF configuration 200, that includes two first ceramic filter portions 1202, two second ceramic filter portions 1204, two third ceramic filter portions 1206, and a single fourth ceramic filter portion 1208. Moreover, a midpoint of fourth ceramic filter portion 1208 may be aligned with a mirroring plane 1210 of BPF 1200, and one of each of the two first ceramic filter portions 1202, the two second ceramic filter portions 1204, and the two third ceramic filter portions 1206 may be aligned on either side of mirroring plane 1210. Moreover, in at least some examples, second ceramic filter portions 1204 may be rotated 180 degrees about a major axis of BPF 1200 relative to each other, as may be third ceramic filter portions 1206. While BPF 1200 represents a four-pole filter, other BPFs may provide greater numbers of poles by employing different numbers of the same components or portions.

In some embodiments, each of first ceramic filter portions 1202, second ceramic filter portions 1204, third ceramic filter portions 1206, and fourth ceramic filter portion 1208 may be bonded together (e.g., using an adhesive, such as epoxy, that may permit an RF wave to propagate therethrough with minimal signal loss). Further, in some examples, a conductive coating (e.g., a silver coating) may be applied to any or all exterior surfaces of BPF 1200 (e.g., after bonding the various components together). In some embodiments, a housing (not shown in FIG. 12) may retain most or all of the components of BPF 1200 in a desired physical relationship to each other during the bonding process, and in some cases, that housing, or another housing, may be used during installation and operation of BPF 1200 (e.g., to provide structural integrity to BPF 1200).

As explained above in conjunction with FIGS. 1-12, the exemplary BPF configurations described herein may result in the production of smaller, lighter, more reliable, and better performing BPFs that may be more easily and quickly deployed in the field. Additionally, the associated methods of manufacture for such BPFs may facilitate a less expensive and more repeatable manufacturing process. Moreover, such benefits may greatly affect, in a positive manner, the cost, performance, and maintainability of associated duplexers and wireless communication systems (e.g., 4G and 5G wireless cellular communication systems) in which such BPFs are incorporated.

EXAMPLE EMBODIMENTS

Example 1: A radio frequency (RF) bandpass filter may include an RF transmission medium that defines (1) a plurality of cavities aligned parallel to each other along a major axis, where (a) each of the cavities includes a plurality of planar surfaces that define (i) a first dimension aligned with the major axis and (ii) a second dimension and a third dimension that are aligned perpendicular to the major axis and each other, where the first dimension is shorter than the second dimension and the third dimension and (b) each adjacent pair of cavities is coupled by an inter-cavity slot, (2) an RF inlet that couples an RF signal received at the RF bandpass filter to a first cavity of the plurality of cavities at a first end of the plurality of cavities, and (3) an RF outlet that couples a filtered RF signal from a second cavity of the plurality of cavities at a second end of the plurality of cavities opposite the first end externally to the RF bandpass filter.

Example 2: The RF bandpass filter of Example 1, where (1) the RF bandpass filter may further include a conductive housing and (2) the RF transmission medium may include air.

Example 3: The RF bandpass filter of Example 2, where the conductive housing may include aluminum.

Example 4: The RF bandpass filter of Example 2, where the filter may further include a conductive coating covering at least some portions of the conductive housing.

Example 5: The RF bandpass filter of Example 1, where the RF transmission medium may include a material having a dielectric constant greater than one.

Example 6: The RF bandpass filter of Example 5, where the material may include a ceramic.

Example 7: The RF bandpass filter of Example 5, where the filter may further include a conductive coating covering at least some portions of the RF transmission medium.

Example 8: The RF bandpass filter of any one of Examples 1-7, where the plurality of cavities may include the first cavity, the second cavity, a third cavity adjacent the first cavity, and a fourth cavity adjacent the third cavity.

Example 9: The RF bandpass filter of Example 8, where (1) each inter-cavity slot may include a rectangular cross-section when viewed along the major axis, (2) the rectangular cross-section of each inter-cavity slot may define a major dimension and a minor dimension less than the major dimension, (3) the major dimension of the rectangular cross-section of a first inter-cavity slot coupling the first cavity to the third cavity may be aligned with the second dimension, (4) the major dimension of the rectangular cross-section of a second inter-cavity slot coupling the third cavity to the fourth cavity may be aligned with the third dimension, and (5) the major dimension of the rectangular cross-section of a third inter-cavity slot coupling the fourth cavity to the second cavity may be aligned with the second dimension.

Example 10: The RF bandpass filter of Example 9, where, when viewed along the major axis, (1) a portion of the rectangular cross-section of the first inter-cavity slot may overlap a first end of the rectangular cross-section of the second inter-cavity slot and (2) a second end of the rectangular cross-section of the second inter-cavity slot may overlap a portion of the rectangular cross-section of the third inter-cavity slot.

Example 11: The RF bandpass filter of Example 8, where the plurality of cavities may further include a fifth cavity adjacent the third cavity, a sixth cavity adjacent the fourth cavity, a seventh cavity adjacent the fifth cavity, and an eighth cavity adjacent the sixth cavity.

Example 12: The RF bandpass filter of any one of Examples 1-7, where each cavity of the plurality of cavities may approximate a rectangular cuboid.

Example 13: The RF bandpass filter of Example 12, where the first cavity may further define (1) a first notch occupying a first corner region of the rectangular cuboid, (2) a second notch occupying a second corner region of the rectangular cuboid diagonally opposite the rectangular cuboid from the first corner region, (3) a third corner region between the first corner region and the second corner region, and (4) a fourth corner region diagonally opposite the rectangular cuboid from the third corner region.

Example 14: The RF bandpass filter of Example 13, where a subsequent cavity adjacent the first cavity may further define (1) a first corner region, a second corner region, a third corner region, and a fourth corner region aligning along the major axis with the first corner region, the second corner region, the third corner region, and the fourth corner region, respectively, of the first cavity, (2) a first notch occupying the third corner region of the subsequent cavity, and (3) a second notch occupying the fourth corner region of the subsequent cavity.

Example 15: The RF bandpass filter of any one of Examples 1-7 where at least one of the RF inlet and the RF outlet may be configured to be coupled with a waveguide.

Example 16: An RF duplexer may include (1) an antenna port, (2) a transmission port, (3) a reception port, (4) a first bandpass filter that couples the transmission port to the antenna port, and (5) a second bandpass filter that couples the reception port to the antenna port, (6) where each of the first bandpass filter and the second bandpass filter includes an RF transmission medium that defines a plurality of cavities aligned parallel to each other along a major axis, where (a) each of the cavities includes a plurality of planar surfaces that define (i) a first dimension aligned with the major axis and (ii) a second dimension and a third dimension that are aligned perpendicular to the major axis and each other, where the first dimension is shorter than the second dimension and the third dimension, and (b) each adjacent pair of cavities is coupled by an inter-cavity slot.

Example 17: A method of manufacturing a radio frequency (RF) bandpass filter may include (1) creating a set of conductive plates and (2) assembling the set of conductive plates side-by-side along a major axis to form the RF bandpass filter, where the RF bandpass filter includes an RF transmission medium that defines (1) a plurality of cavities aligned parallel to each other along the major axis, where (a) each of the cavities includes a plurality of planar surfaces that define (i) a first dimension aligned with the major axis and (ii) a second dimension and a third dimension that are aligned perpendicular to the major axis and each other, where the first dimension is shorter than the second dimension and the third dimension and (b) each adjacent pair of cavities is coupled by an inter-cavity slot.

Example 18: The method of Example 17, where the RF transmission medium may further include (1) an RF inlet that couples an RF signal received at the RF bandpass filter to a first cavity at a first end of the plurality of cavities and (2) an RF outlet that couples a filtered RF signal from a second cavity at a second end of the plurality of cavities opposite the first end externally to the RF bandpass filter.

Example 19: The method of either Example 17 or Example 18, where the set of conductive plates may include aluminum.

Example 20: The method of either Example 17 or Example 18, where the method may further include coating at least a portion of the set of conductive plates with a conductive layer.

The process parameters and sequence of the steps described and/or illustrated herein are given by way of example only and can be varied as desired. For example, while the steps illustrated and/or described herein may be shown or discussed in a particular order, these steps do not necessarily need to be performed in the order illustrated or discussed. The various exemplary methods described and/or illustrated herein may also omit one or more of the steps described or illustrated herein or include additional steps in addition to those disclosed.

The preceding description has been provided to enable others skilled in the art to best utilize various aspects of the exemplary embodiments disclosed herein. This exemplary description is not intended to be exhaustive or to be limited to any precise form disclosed. Many modifications and variations are possible without departing from the spirit and scope of the present disclosure. The embodiments disclosed herein should be considered in all respects illustrative and not restrictive. Reference should be made to the appended claims and their equivalents in determining the scope of the present disclosure.

Unless otherwise noted, the terms "connected to" and "coupled to" (and their derivatives), as used in the specification and claims, are to be construed as permitting both direct and indirect (i.e., via other elements or components) connection. In addition, the terms "a" or "an," as used in the specification and claims, are to be construed as meaning "at least one of." Finally, for ease of use, the terms "including" and "having" (and their derivatives), as used in the specification and claims, are interchangeable with and have the same meaning as the word "comprising."

What is claimed is:

1. A radio frequency (RF) bandpass filter comprising an RF transmission medium that defines:

a plurality of cavities aligned parallel to each other along a major axis, wherein:

each of the cavities comprises a plurality of planar surfaces that define:

a first dimension aligned with the major axis, and a second dimension and a third dimension that are aligned perpendicular to the major axis and each other, wherein the first dimension is shorter than the second dimension and the third dimension; and each adjacent pair of cavities is coupled by an inter-cavity slot wherein:

each inter-cavity slot overlaps a portion of a consecutive inter-cavity slot in a manner that tunes a resonance frequency with a zero-transition corresponding with the overlap;

an RF inlet that couples an RF signal received at the RF bandpass filter to a first cavity of the plurality of cavities at a first end of the plurality of cavities; and an RF outlet that couples a filtered RF signal from a second cavity of the plurality of cavities at a second end of the plurality of cavities opposite the first end externally to the RF bandpass filter.

2. The RF bandpass filter of claim 1, wherein:

the RF bandpass filter further comprises a conductive housing; and the RF transmission medium comprises air.

3. The RF bandpass filter of claim 2, wherein the conductive housing comprises aluminum.

4. The RF bandpass filter of claim 2, further comprising a conductive coating covering at least some portions of the conductive housing.

5. The RF bandpass filter of claim 1, wherein the RF transmission medium comprises a material having a dielectric constant greater than one.

6. The RF bandpass filter of claim 5, wherein the material comprises a ceramic.

7. The RF bandpass filter of claim 5, further comprising a conductive coating covering at least some portions of the RF transmission medium.

8. The RF bandpass filter of claim 1, wherein the plurality of cavities comprises the first cavity, the second cavity, a third cavity adjacent the first cavity, and a fourth cavity adjacent the third cavity.

9. The RF bandpass filter of claim 8, wherein:

each inter-cavity slot is sized, shaped, and positioned relative to the consecutive inter-cavity slot to create the zero transition; and each inter-cavity slot is positioned perpendicular relative to at least one of an immediately preceding or an immediately subsequent inter-cavity slot.

10. The RF bandpass filter of claim 9, wherein the zero-transition created by the inter-cavity slots results in a low S-parameter gain valley of approximately −100 dB.

11. The RF bandpass filter of claim 8, wherein the plurality of cavities further comprises a fifth cavity adjacent the third cavity, a sixth cavity adjacent the fourth cavity, a seventh cavity adjacent the fifth cavity, and an eighth cavity adjacent the sixth cavity.

12. The RF bandpass filter of claim 1, wherein each cavity of the plurality of cavities approximates a rectangular cuboid.

13. The RF bandpass filter of claim 12, wherein the first cavity further defines:

a first notch occupying a first corner region of the rectangular cuboid;

a second notch occupying a second corner region of the rectangular cuboid diagonally opposite the rectangular cuboid from the first corner region;

a third corner region between the first corner region and the second corner region; and a fourth corner region diagonally opposite the rectangular cuboid from the third corner region.

14. The RF bandpass filter of claim 13, wherein a subsequent cavity adjacent the first cavity further defines:

a first corner region, a second corner region, a third corner region, and a fourth corner region aligning along the major axis with the first corner region, the second corner region, the third corner region, and the fourth corner region, respectively, of the first cavity;

a first notch occupying the third corner region of the subsequent cavity; and a second notch occupying the fourth corner region of the subsequent cavity.

15. The RF bandpass filter of claim 1, wherein at least one of the RF inlet and the RF outlet is configured to be coupled with a waveguide.

16. An RF duplexer that comprises:

an antenna port;

a transmission port;

a reception port;

a first bandpass filter that couples the transmission port to the antenna port; and a second bandpass filter that couples the reception port to the antenna port;

wherein each of the first bandpass filter and the second bandpass filter comprises an RF transmission medium that defines a plurality of cavities aligned parallel to each other along a major axis, wherein:

each of the cavities comprises a plurality of planar surfaces that define:

a first dimension aligned with the major axis, and a second dimension and a third dimension that are aligned perpendicular to the major axis and each other, wherein the first dimension is shorter than the second dimension and the third dimension; and each adjacent pair of cavities is coupled by an inter-cavity slot, wherein:

each inter-cavity slot overlaps a portion of a consecutive inter-cavity slot in a manner that tunes a resonance frequency with a zero-transition corresponding with the overlap.

17. A method of manufacturing a radio frequency (RF) bandpass filter, the method comprising:

creating a set of conductive plates; and assembling the set of conductive plates side-by-side along a major axis to form the RF bandpass filter, wherein the RF bandpass filter comprises an RF transmission medium that defines:

a plurality of cavities aligned parallel to each other along the major axis, wherein:

each of the cavities comprises a plurality of planar surfaces that define:

a first dimension aligned with the major axis, and a second dimension and a third dimension that are aligned perpendicular to the major axis and each other, wherein the first dimension is shorter than the second dimension and the third dimension; and each adjacent pair of cavities is coupled by an inter-cavity slot, wherein:

each inter-cavity slot overlaps a portion of a consecutive inter-cavity slot in a manner that tunes a resonance frequency with a zero-transition corresponding with the overlap.

18. The method of claim 17, wherein the RF transmission medium further comprises:

an RF inlet that couples an RF signal received at the RF bandpass filter to a first cavity at a first end of the plurality of cavities; and an RF outlet that couples a filtered RF signal from a second cavity at a second end of the plurality of cavities opposite the first end externally to the RF bandpass filter.

19. The method of claim 17, wherein the set of conductive plates comprises aluminum.

20. The method of claim 17, further comprising coating at least a portion of the set of conductive plates with a conductive layer.

* * * * *